United States Patent [19]

Vermeren

[11] 4,178,473

[45] Dec. 11, 1979

[54] TWO-WAY LOUDSPEAKER FOR VEHICLE

[75] Inventor: Joseph P. Vermeren, Winlock, Wash.

[73] Assignee: Acoustic Fiber Sound Systems, Inc., Indianapolis, Ind.

[21] Appl. No.: 919,079

[22] Filed: Jun. 26, 1979

[51] Int. Cl.[2] ..... H04R 1/20

[52] U.S. Cl. ..... 179/1 VE; 179/1 E; 181/145; 181/150

[58] Field of Search ..... 179/1 E, 1 GA, 1 VE, 179/115.5 PS; 181/144, 145, 146, 147

[56] References Cited

U.S. PATENT DOCUMENTS 1,902,250 3/1933 Lindenberg ..... 181/147

FOREIGN PATENT DOCUMENTS 2605936 8/1977 Fed. Rep. of Germany ..... 179/1 E 1420714 1/1976 United Kingdom ..... 179/1 E

*Primary Examiner*—George G. Stellar

*Attorney, Agent, or Firm*—Vogel, Dithmar, Stotland, Stratman & Levy

[57] ABSTRACT

A combination speaker assembly including an annular housing having a peripheral wall with an opening therein and having first and second open ends, a first speaker for reproducing audio mid frequencies and audio high frequencies mounted essentially within the housing in alignment with the opening to project the output of the first speaker out of the housing through the opening, and a second speaker for reproducing audio low frequencies mounted adjacent to the first open end to inject the output of the second speaker into the housing and past the first speaker and out the second open end, the acoustical axis of the first speaker being arranged essentially normal to the acoustical axis of the second speaker and in use being directed essentially toward the ears of the listener.

12 Claims, 6 Drawing Figures

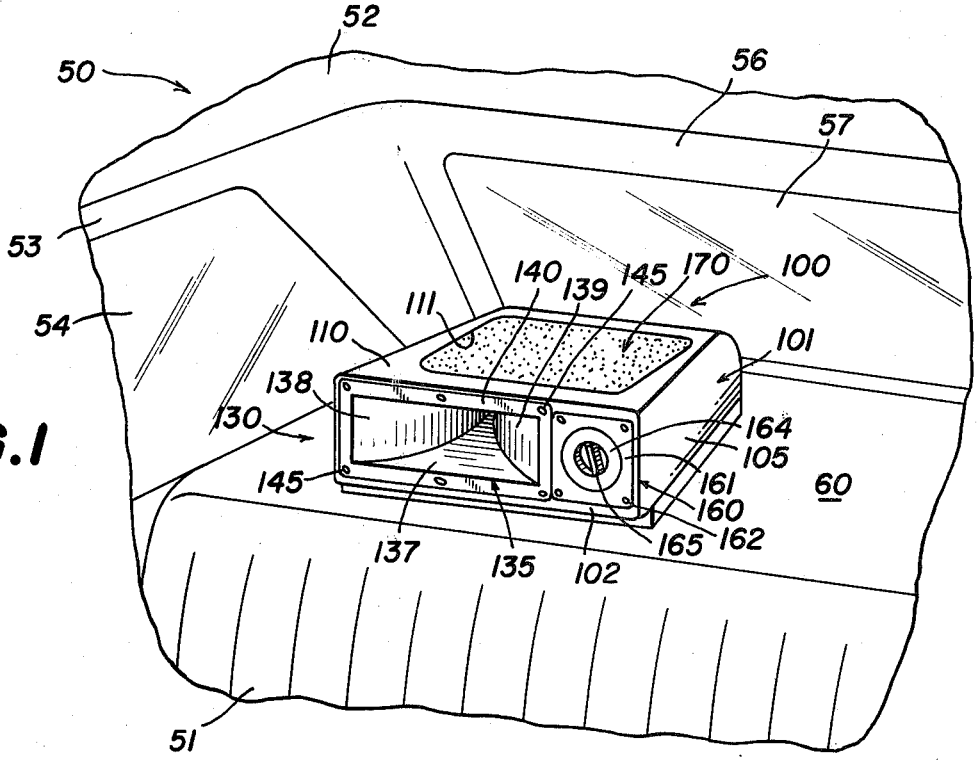
FIG.1
FIG.2
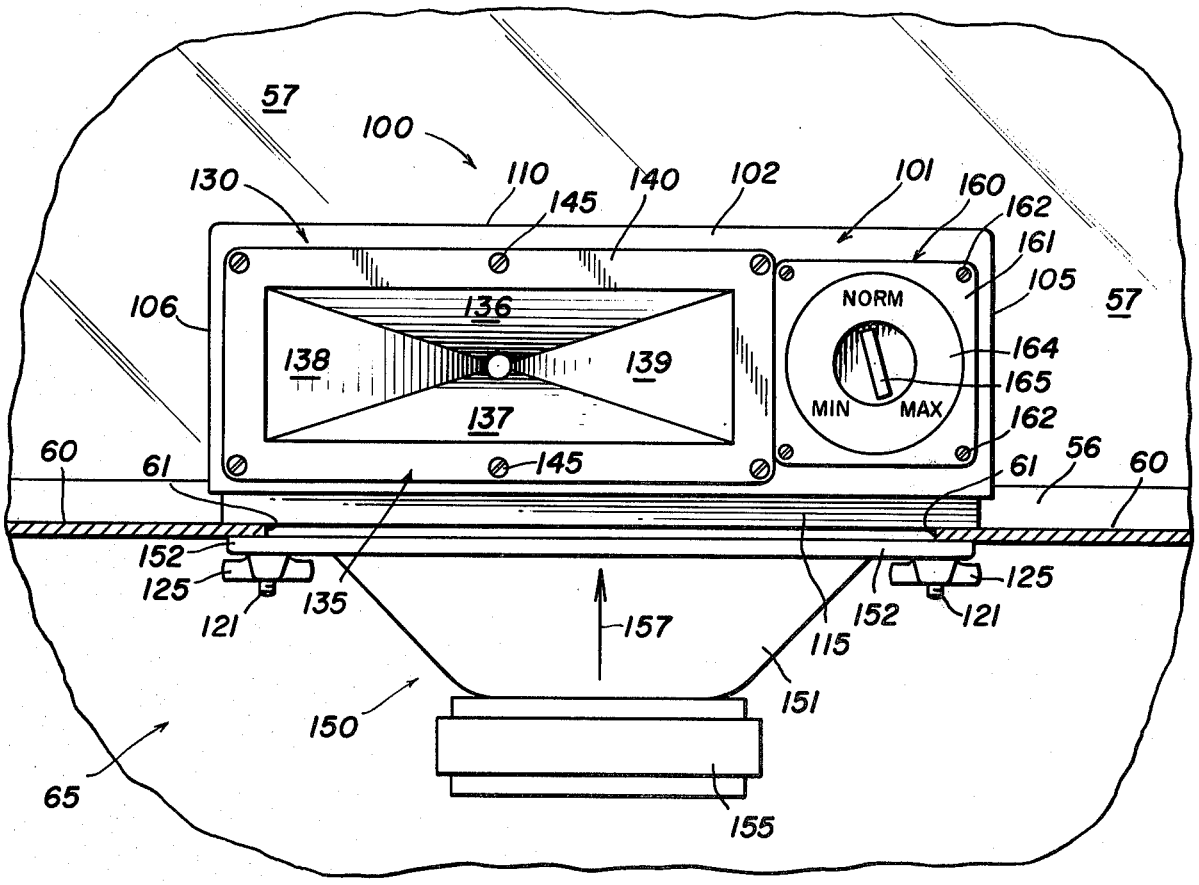

TWO-WAY LOUDSPEAKER FOR VEHICLE

BACKGROUND OF THE INVENTION AND PRIOR ART STATEMENT

The present invention relates generally to improvements in loudspeaker assemblies, and specifically to the provision of a loudspeaker assembly incorporating a first speaker for reproducing audio mid frequencies and audio high frequencies and a second speaker for reproducing audio low frequencies, the speakers being arranged so as to provide controlled dispersion of the mid frequencies and high frequencies and low frequency saturation.

The speaker assembly of the present invention is particularly adapted for use in vehicles and other confined spaces. A typical place for mounting the speaker assembly of the present invention is on the package deck of an automobile just in front of the rear window, or in side panels and door panels in such vehicles. Problems have been encountered in providing adequate sound reproduction in such vehicles heretofore because in an attempt to overcome road noises, mechanical noises and wind noises, which are dominantly in the low frequency range, such vehicles are designed with the most sound absorbent interiors possible. As a result, it is necessary to utilize a very large speaker for reproducing the audio low frequencies to overcome the above noted noises and sound absorbent interiors in order to produce the necessary bass saturation. The provision of the large low frequency speaker presents a space utilization problem. The mid frequency and high frequency speaker also presents a problem in obtaining optimum dispersion of these frequencies.

Prior to the present invention, vehicle speakers fell into two broad classifications: (1) a surface mounted small wedge or box and (2) a flush-mounted door, deck or panel type. The small wedge or box is limited in allowable speaker size to reproduce the low frequencies by visibility and available space considerations on the package shelf. Limiting the size of the low frequency speaker in turn limits the bass response which is directly related thereto. The flush mounted speaker, which might be a co/tri axial or 2+2 (woofer and tweeter), cannot control the dispersion of high frequencies and mid frequencies. If the flush mount is on the rear package deck, the mid frequencies and high frequencies are lost when the sound hits the overlying rear window. In some cases the angle of inclination of the rear window reflects the sound into the liner covering the roof of the vehicle or below the ear level of the listener. If the flush mount is in the door or side panel, mid frequencies and high frequencies are normally driven into the feet, seats or across a narrow path, usually out of the listeners range. If the flush mount system is a co/tri axial, the low frequencies are sacrificed and too many mid frequencies are produced.

These various problems are solved in the present invention by providing two speakers, one being a woofer to reproduce the audio low frequencies, the other being an exponential horn to reproduce the audio mid frequencies and the audio high frequencies, the acoustical axes of the speakers being arranged essentially normal with the acoustical axis of the speaker reproducing the mid frequencies and the high frequencies being directed essentially toward the ears of the listener. Such an arrangement provides for controlled dispersion of the mid and high frequencies which are very directional with the beam or path of the sound being narrower as the frequency increases. By directing the dispersion of the mid frequencies and high frequencies at the ears of the listener, every passenger within the vehicle receives the same frequency balance, with the mid frequencies and the high frequencies smooth, clean and clear. The novel arrangement of the present invention also provides low frequency saturation from the speaker reproducing the low frequencies. The low frequency speaker being free of restricting plates, brackets, and the like, has no corresponding wave stand off and phase cancellation. As a result, there is an efficient generation of the low frequencies and full distribution thereof and saturation within the passenger compartment of the vehicle.

U.S. Pat. No. 2,688,373 granted Sept. 7, 1954 to H. F. Olson shows two speakers with the axes disposed normal to each other, but the speakers are not arranged in the housing in accordance with the present invention, and rather the audio high frequencies must in some fashion pass through the cone of the low frequency speaker, which arrangement has been found to be unsatisfactory. U.S. Pat. No. 2,927,657 granted Mar. 8, 1960 to L. J. Patla et al. also shows speakers with the acoustical axes thereof disposed normal to each other, but the speakers are disposed in separate housings so as not to achieve the very substantial economy of space required for the successful mounting in vehicles such as in the present invention. U.S. Pat. No. 3,637,938 granted Jan. 25, 1972 to H. F. Kuhlow et al. likewise shows speakers with the acoustical axes normal to each other, but the speakers are mounted in an entirely different manner than that of the present invention with respect to the housing therefor, whereas to occupy an inordinate amount of space, thus not achieving the space utilization efficiency, optimum dispersion of the mid frequencies and high frequencies, and the saturation of the low frequencies achieved by the present invention.

SUMMARY OF THE INVENTION

The present invention provides a combination speaker assembly which incorporates a high space utilization efficiency, an optimum dispersion of the mid frequencies and high frequencies, and produces an abundant bass saturation when used in vehicles.

This is accomplished in the present invention, and it is an object of the present invention to accomplish these desired results, by providing a combination speaker assembly including an annular housing having a peripheral wall with an opening therein and having first and second open ends, a first speaker for reproducing audio mid frequencies and audio high frequencies mounted essentially within the housing in alignment with the opening to project the output of the first speaker out of the housing through the opening, and a second speaker for reproducing audio low frequencies mounted adjacent to the first open end to inject the output of the second speaker into the housing the past the first speaker and out the second open end, the acoustical axis of the first speaker being arranged essentially normal to the acoustical axis of the second speaker and in use being directed essentially toward the ears of the listener.

In connection with the foregoing object, it is another object of the invention to provide a combination speaker assembly of the type set forth wherein the first speaker is a dynamic exponential horn having a frequency response in the range from about 1200 Hz. to about 20 KHz., and the second speaker is a woofer having a frequency response in the range from about 35 Hz. and up.

Yet another object of the invention is to provide a combination speaker assembly of the type set forth wherein the acoustical axis of the first speaker is offset with respect to the acoustical axis of the second speaker.

Still another object of the invention is to provide a combination speaker assembly of the type set forth wherein the second open end is closed by a grille that is acoustically transparent, the grille being preferably formed of a foamed plastic.

A further object of the invention is to provide a combination speaker assembly of the type set forth and further including a control for balancing the outputs of the speakers to achieve the desired relation among the low frequencies on the one hand and the mid frequencies and the high frequencies on the other hand.

Further features of the invention pertain to the particular arrangement of the parts of the combination speaker assembly, whereby the above outlined and additional operating features thereof are attained.

The invention, both as to its organization and method of operation, together with further features and advantages thereof will best be understood with reference to the following specification taken in connection with the accompanying drawings.

BRIEF DESCRIPTION OF THE DRAWINGS

FIG. 1 is a partial perspective view of the rear package shelf of a vehicle having mounted thereon and over the underlying trunk compartment a combination speaker assembly made in accordance with and embodying the principles of the present invention;

FIG. 2 is an enlarged view in front elevation of the combination speaker assembly of FIG. 1;

DESCRIPTION OF THE PREFERRED EMBODIMENTS

Figure 3:
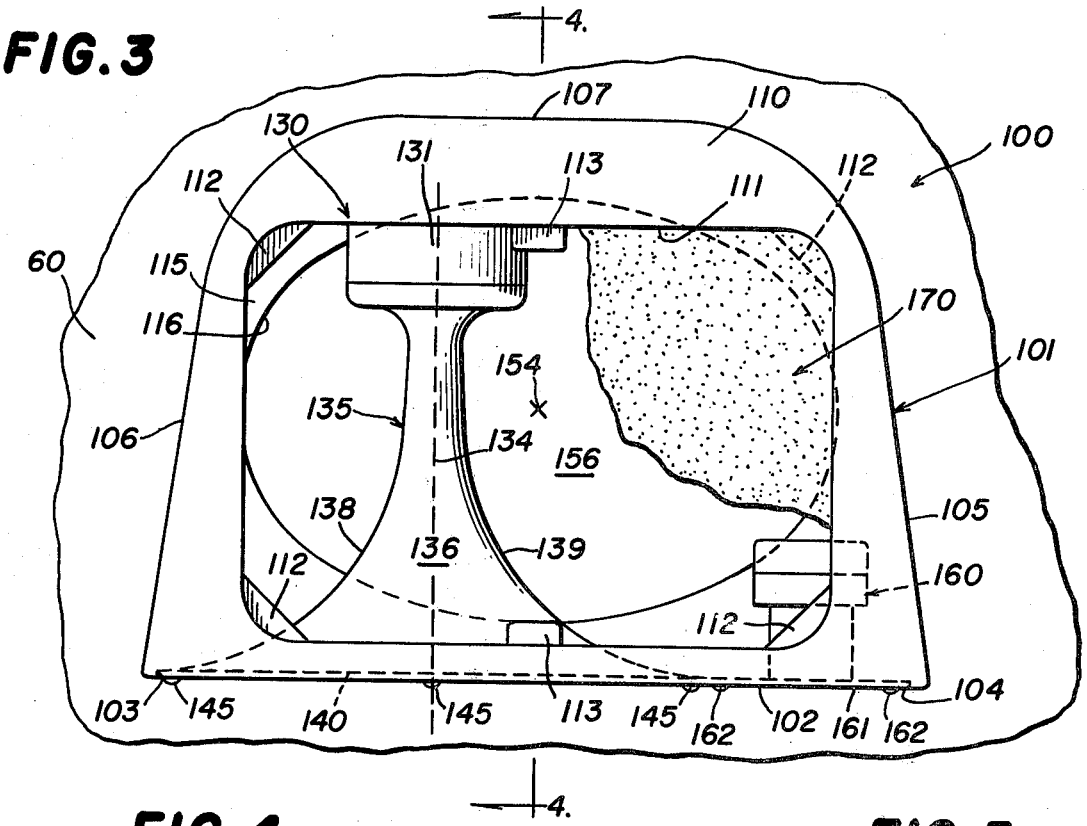
FIG. 3 is a plan view of the combination speaker assembly of FIG. 2 with a portion of the grille removed.

Referring to FIGS. 1 through 4 of the drawings, there is illustrated a combination speaker assembly 100 made in accordance with and embodying the principles of the present invention installed in a car 50, and particularly on the rear package shelf 60 thereof. As illustrated, the car 50 includes a rear seat 51 disposed forwardly of the package shelf 60 and overlying the rear seat 51 is a ceiling 52 extending downwardly from which is a side wall 53 having a side window 54 and a rear wall 56 having a rear window 57. The package shelf 60 extends from the rear seat 51 rearwardly to the rear wall 56 and laterally between the two car side walls 53. As is customary, the rear seat 51, the ceiling 52, the side walls 53 and the rear wall 56 are covered with upholstery or other sound absorbent materials in order to overcome road noises, mechanical noises and wind noises associated with the operation of the car 50. Disposed beneath the package shelf 60 is a trunk area generally designated by the numeral 65 in FIG. 2. In order to mount the combination speaker assembly 100 on the package shelf 60, the package shelf 60 has a generally elliptical opening 61 therein with holes disposed therearound to receive fasteners, all as will be explained more fully hereinafter.

The combination speaker assembly 100 includes a box-like housing 101 formed preferably of molded plastic. The housing 101 includes a front wall 102 disposed vertically on the package shelf 60 and spaced just a short distance rearwardly of the rear seat 51. The front wall 102 has an opening 103 therein to receive a speaker, all as will be explained more fully hereinafter. Extending rearwardly from the sides of the front wall 102 are side walls 105 and 106 which also converge rearwardly and join a rear wall 107.

Interconnecting the upper edges of the front wall 102, the side walls 105 and 106 and the rear wall 107 is a top wall 110. The top wall 110 has a generally rectangular opening 111 therein that permits sound to exit therefrom and in the corners of the opening 111 are recessed corner supports 112, and on the front wall 102 and the rear wall 107 are recessed side supports 113. The bottom of the housing 101 is essentially closed by a bottom wall 115 having an oval opening 116 centrally thereof and having holes (not shown) for receiving bolts 122 having threaded shanks 121 to receive wing nuts 125, all cooperating to mount the combination speaker assembly 100 on the associated package shelf 60.

Disposed essentially within the housing 101 is a first speaker 130 which is adapted and designed for reproducing audio mid frequencies and audio high frequencies. As illustrated, the first speaker 130 is of the dynamic exponential horn type and includes a magnet housing 131 disposed rearwardly and exponential horn 135 extending forwardly from the magnet housing 131. The exponential horn 135 is essentially rectangular in cross section transverse to the acoustical axis thereof with the acoustical axis disposed centrally of the exponential horn 135 at all points therealong. The horn 135 is formed of two main walls 136 and 137 that are joined by two side walls 138 and 139. The forward edges of the walls 136 through 139 are joined by an outwardly directed flange 140 that has openings therein receiving fasteners 145 for mounting the exponential horn 135 of the first speaker 130 on the front wall 102 of the housing 101. From FIG. 3, it will be seen that the magnet housing 131 is disposed to the rear within the housing 101 and adjacent to the rear wall 107 with the horn 135 extending forwardly therefrom and terminating essentially in the front wall 102. It further will be noted that the acoustical axis 134 of the speaker 130 that is disposed vertically in FIG. 3 and horizontally in FIG. 4 is disposed to the left of the midline of the housing 101 as viewed in FIG. 3.

A second speaker 150 is provided for reproducing audio low frequencies, the speaker 150 being commonly referred to as a woofer. The speaker 150 includes a basket or frame 151 having a forward out-turned flange 152 with openings therein that receive the threaded shanks 121 of the bolts 122 therethrough. Mounted on the lower end of the basket 151 as viewed in FIGS. 2 and 4 is a magnet 155 that drives a cone 156 (see FIG. 3). The opening 61 in the package shelf 60 is in alignment with the opening 116 in the bottom wall 115 and the flange 152 is shaped to surround the openings 61 and 116, whereby all of these parts can be placed in alignment and each has aligned openings therein that receive the shanks 121 of the bolts 122 therethrough. Application of the wing nuts 125 to the threaded shanks 121 thereby serve to mount the speaker 150 below the package shelf 60 and onto the housing 101.

Figure 4:
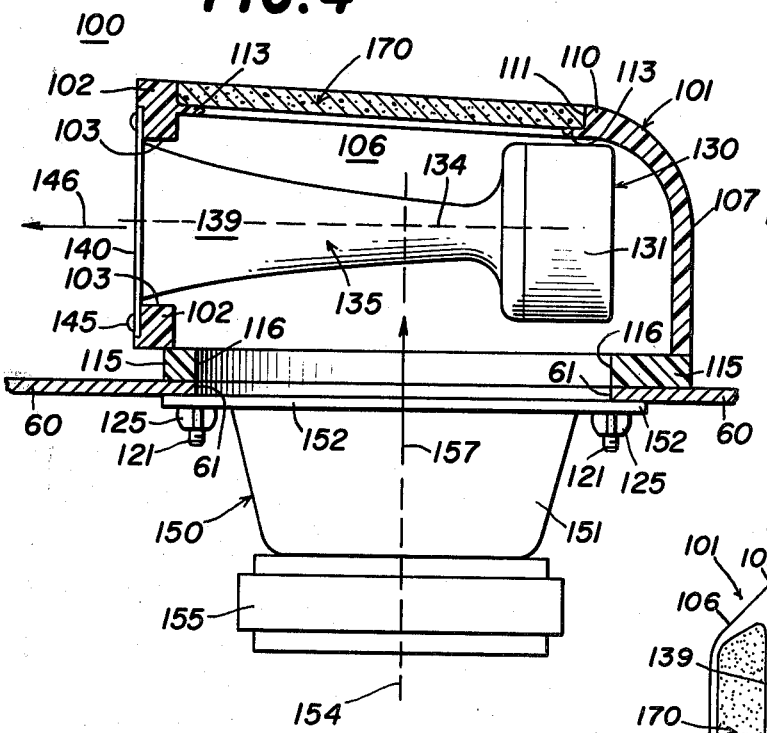
FIG. 4 is a view in vertical section along the line 4—4 of FIG. 3.

The acoustical axis of the speaker 150 is disposed essentially in the geometrical center of the basket 151 and the cone 156 thereof and is oriented vertically, the numeral 154 having been applied thereto in FIG. 3.

Different cars 50 have different acoustical characteristics, this resulting from the difference in the upholstery applied to the inner surfaces thereof, the area of glass and other hard reflective surfaces that are exposed, etc. Glass and hard reflective surfaces require less volume at mid frequencies and high frequencies because of the reflective properties thereof. Plush luxury interiors absorb sound and require a substantially greater volume of audio low frequencies. Accordingly, it is desirable to be able to balance the output from the speakers 130 and 150 so as to balance the output of the mid frequencies and high frequencies generated by the speaker 130 on the one hand with the low frequencies generated by the speaker 150 on the other hand. To this end, a balance control 160 has been provided so that the outputs of the two speakers can be selectively attenuated and thereby balanced. The control 160 includes a frame 161 (see FIG. 3 also) having fasteners 162 securing the control 160 on the front wall 102 of the housing 101. In order to control the attenuation provided by the balance control 160, a control knob 165 has been provided with a cooperating dial 164 with suitable legends thereon.

Finally, there is provided a grille 170 closing the opening 111 in the top wall 110, the grille 170 resting upon the corner support 112 and the side supports 113. The grille 170 may be made of any material that is acoustically transparent. A preferred material of construction of the grille 170 is a foamed plastic, the preferred plastic being polyurethane.

An important feature of the present invention resides in the fact that the acoustical axes of the speakers 130 and 150 are disposed essentially normal to each other. More specifically, in the typical installation illustrated in FIGS. 1 to 4, the acoustical axis 134 of the speaker 130 is directed essentially horizontally and forwardly so that the output from the speaker 130, which are the audio mid frequencies and audio high frequencies, are directed toward the ears of the listener sitting on the rear seat 51 and the front seat (not shown) of the car 50. The acoustical axis 154 of the speaker 150 is oriented essentially vertically and therefore essentially normal to the acoustical axis 134 of the speaker 130. As will be seen in FIG. 3, the acoustical axes 134 and 154 are offset laterally, but are essentially normal one to the other.

The arrangement of the acoustical axes of the speakers 130 and 150 results in space utilization efficiency accompanied with an optimum dispersion of the audio mid frequencies and audio high frequencies, with the production of abundant audio low frequency saturation within the car 50. Space utilization efficiency is achieved because the speaker 150 is essentially disposed in the trunk area 65 below the package shelf 60, the trunk area 65 accommodating an adequate size of woofer 150 without being limited by the size of the housing 101 and the area provided between the package shelf 60, the rear window 67 and the ceiling 52. Space utilization is so efficient that full size woofers 150 can be used to provide the strong production of audio low frequencies. The woofer 150 is also free of restricting plates and brackets, and remains free from corresponding wave standoff and phase cancellation. The output of the woofer 150 passes easily around the horn 135 and through the grille 170 which is acoustically transparent and allows efficient passage of the audio low frequencies therethrough.

The novel arrangement of the present invention also provides for controlled dispersion of the audio mid frequencies and audio high frequencies. Mid frequencies and high frequencies are very directional. The higher the frequency, the narrower the beam of sound issued therefrom. The wide variance in the angle of mounting of the rear window 57 and the adverse effect on dispersion prohibits orientation of the speaker 130 in any direction other than that illustrated. Controlled dispersion of the mid frequencies and the high frequencies is achieved by the direct horizontal mounting of the radiating exponential horn 135. The broad pattern produced is directed essentially at and toward the ears of the listeners in the seats of the car 50. The audio mid frequencies and the audio high frequencies are reproduced in a manner such that these frequencies are smooth, clean and clear to the listener no matter where seated in the car 50.

By use of the balance control 160, the individual characteristics of the car 50 can be accommodated, as well as the individual tastes of the listener using the combination speaker assembly 100. Depending upon the acoustical characteristics of the interior of the car 50 and the preference of the listener, either the audio mid frequencies and the audio high frequencies emitted by the exponential horn 135 or the audio low frequencies emitted by the woofer 150 can be accentuated or suppressed and attenuated so as to derive the desired balance therebetween.

Figure 5:
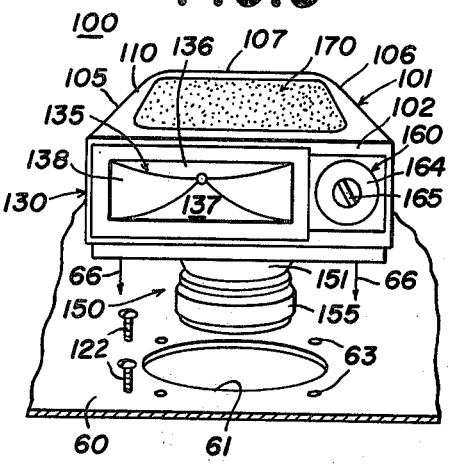
FIG. 5 is an exploded view on a reduced scale illustrating the mounting of a combination speaker assembly of the present invention on the rear package shelf in an automobile.

There is illustrated in FIG. 5 of the drawings a modification wherein the speaker 150 is mounted directly on the bottom wall 115 of the housing 101, and the combined assembly is mounted upon a package shelf 60 having an appropriate opening 61 therein, the speaker assembly 100 being retained on the package shelf 60 by four screws 122 extending through the bottom wall 115 and threaded into corresponding holes 63 which may be provided with suitable attached fasteners.

Figure 6:
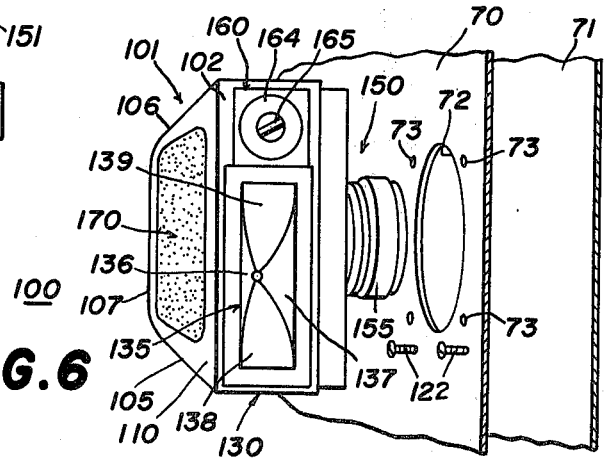
FIG. 6 is a view similar to FIG. 5 and illustrating the mounting of a combination speaker assembly of the present invention on a side panel in a vehicle.

In FIG. 6 of the drawings, there is illustrated yet another form of mounting of the speaker assembly 100, this form of mounting being on a side panel of a vehicle, the side panel having an inner side panel 70 and an outer panel 71, the inner side panel 70 having an oval opening 72 therein surrounded by four holes 73 to receive the screws 122 therein. In this manner, the speaker assembly 100 can be mounted on a vertical wall while retaining all of the desirable acoustical characteristics. More specifically, the output of the exponential horn 135 is still directed essentially at the ears of the listeners, while the woofer 150 is disposed in an area where there is no limitation upon its size, thus to assure a strong production of audio low frequencies.

While there has been described what is at present considered to be the preferred embodiments of the invention, it will be understood that various modifications may be made therein, and it is intended to cover in the appended claims all such modifications as fall within the true spirit and scope of the invention.

What is claimed is:

1. A combination speaker assembly for use in a vehicle comprising an annular housing having a peripheral wall with an opening therein and having first and second open ends, a first speaker for reproducing audio mid frequencies and audio high frequencies mounted essentially within said housing in alignment with said opening to project the output of said first speaker out of said housing through said opening, and a second speaker for reproducing audio low frequencies mounted adjacent to said first open end and outside of said housing to inject the output of said second speaker into said housing and past said first speaker and out said second open end, the acoustical axis of said first speaker being arranged essentially normal to the acoustical axis of said second speaker and in use being directed essentially toward the ears of the listener.

2. The combination speaker and assembly set forth in claim 1, wherein the plane of said opening in said housing is essentially perpendicular to the planes of said first and second open ends.

3. The combination speaker assembly set forth in claim 1, wherein said first speaker is a dynamic exponential horn.

4. The combination speaker assembly set forth in claim 3, wherein said exponential horn has a frequency response in the range from 1200 Hz. to about 20 KHz.

5. The combination speaker assembly set forth in claim 1, wherein said second speaker is a woofer.

6. The combination speaker assembly set forth in claim 5, wherein the frequency response of said woofer is in the range from about 35 Hz. and up.

7. The combination speaker assembly set forth in claim 1, wherein the acoustical axes of said first speaker and said second speaker are laterally offset with respect to each other.

8. The combination speaker assembly set forth in claim 1, and further comprising an acoustically transparent grille covering said second open end.

9. The combination speaker assembly set forth in claim 8, wherein said grille is a sheet of foamed plastic.

10. A combination speaker assembly for use in a vehicle comprising an annular housing having a peripheral wall with an opening therein and having first and second open ends, a first speaker for reproducing audio mid frequencies and audio high frequencies mounted essentially within said housing in alignment with said opening to project the output of said first speaker out of said housing through said opening, a second speaker for reproducing audio low frequencies mounted adjacent to said first open end and outside of said housing to inject the output of said second speaker into said housing and past said first speaker and out said second open end, the acoustical axis of said first speaker being arranged essentially normal to the acoustical axis of said second speaker and in use being directed essentially toward the ears of the listener, and a balancing control mounted on said housing to adjust the balance between the output of said first speaker and said second speaker.

11. The combination speaker assembly set forth in claim 10, wherein said balancing control is mounted in said housing adjacent to said opening.

12. A combination speaker assembly for mounting in a vehicle on a panel having an aperture therein and with one surface thereof disposed toward a listener and the other surface thereof disposed toward a large acoustical chamber, said combination speaker assembly comprising an annular housing having a peripheral wall with an opening therein and having first and second open ends, means mounting said housing upon the first surface of an associated panel with said first open end in general alignment with the aperture in the panel, a first speaker for reproducing audio mid frequencies and audio high frequencies mounted essentially within said housing in alignment with said opening to project the output of said first speaker out of said housing through said opening, and a second speaker for reproducing audio low frequencies mounted within the associated acoustical chamber on the other side of the associated panel and outside of said housing and adjacent to said first open end to inject the output of said second speaker into said housing and past said first speaker and out said second open end, the acoustical axis of said first speaker being arranged essentially normal to the acoustical axis of said second speaker and in use being directed essentially toward the ears of the listener.

* * * * *